United States Patent [19]

Reiche

[11] Patent Number: 4,828,250

[45] Date of Patent: May 9, 1989

[54] SWING WITH SAFETY PLATFORM

[76] Inventor: Elmer P. Reiche, Box 248 D, RD #2, Export, Pa. 15632

[21] Appl. No.: 174,128

[22] Filed: Mar. 28, 1988

[51] Int. Cl.[4] ..... A63G 9/16

[52] U.S. Cl. ..... 272/92; 297/279; 297/434

[58] Field of Search ..... 272/85–92; 297/273–282, 433, 434

[56] References Cited

U.S. PATENT DOCUMENTS

| | | | |
|---|---|---|---|
| 491,172 | 2/1893 | Hart | 297/279 X |
| 683,539 | 10/1901 | Williams | 272/92 |
| 1,107,341 | 8/1914 | Oldfield | 297/273 X |
| 1,189,393 | 7/1916 | Shaw | 297/276 |
| 1,371,197 | 3/1921 | Couch | 272/92 |
| 1,406,529 | 2/1972 | Braymer | 297/434 |
| 1,712,266 | 5/1929 | Grimmich | 297/434 |
| 1,783,502 | 12/1930 | Fry | 272/92 |

*Primary Examiner*—David A. Scherbel
*Assistant Examiner*—Richard E. Chilcot, Jr.
*Attorney, Agent, or Firm*—James C. Valentine

[57] ABSTRACT

A porch, patio or lawn swing is safety grounded when its rider merely steps onto or off of stands on a platform extending below and forwardly of the swing seat. The platform is supported from the seat by a bracket. Preferably, the platform is pivotally supported. A spring is attached to the platform for urging the platform upwardly from the ground. When the rider is seated, the spring raises the platform from the ground and the rider may push on the platform to move the swing.

12 Claims, 3 Drawing Sheets

SWING WITH SAFETY PLATFORM

This invention relates to gently moving swings such as porch swings suspended from ceilings and patio swings suspended from free-standing frames. More particularly, this invention relates to swings having foot rest platforms which propel the swings when a pressure is exerted on the platforms by the feet of the riders sitting on the swings.

These kinds of swings are frequently used by frail people such as the elderly, the handicapped and patients recovering from sickness or operations and by unsupervised young children. They frequently risk injury from slipping or falling when they are boarding or exiting the swings because the moving weight of unseated riders on the platforms causes the swings to sway erratically. Also, they may even by injured while seated when they start the swing by pushing on the ground with an extended foot.

The swing of the present invention safely grounds the swing when people are standing on or are stepping on or off the platform so that the swing cannot be propelled. When the riders are seated on the swing, the swing is then free to sway and they may push on the platform with their feet to propel themselves. The present invention is not at all complicated and many existing lawn, patio and porch swings may be inexpensively modified in accordance with its principle.

The swing of the present invention has a generally horizontally extending seating member with a front portion and a back portion, and has a back rest member extending upwardly of the back portion of the seat. A bracket member is attached to and extends downwardly of the seat for supporting a platform member. Preferably the platform member is pivotally supported. The platform member extends generally horizontally below and beyond the front portion of the seat and has a means for engaging the ground when a rider stands on the platform. A spring means is operatively connected with the platform for urging the ground-engaging means away from the ground when the rider is not standing on the platform.

Other details, objects and advantages of the invention will become apparent as the following descriptions of presently preferred embodiments thereof proceed.

Shown in the accompanying drawings are presently preferred embodiments of the invention in which.

Figure 1:
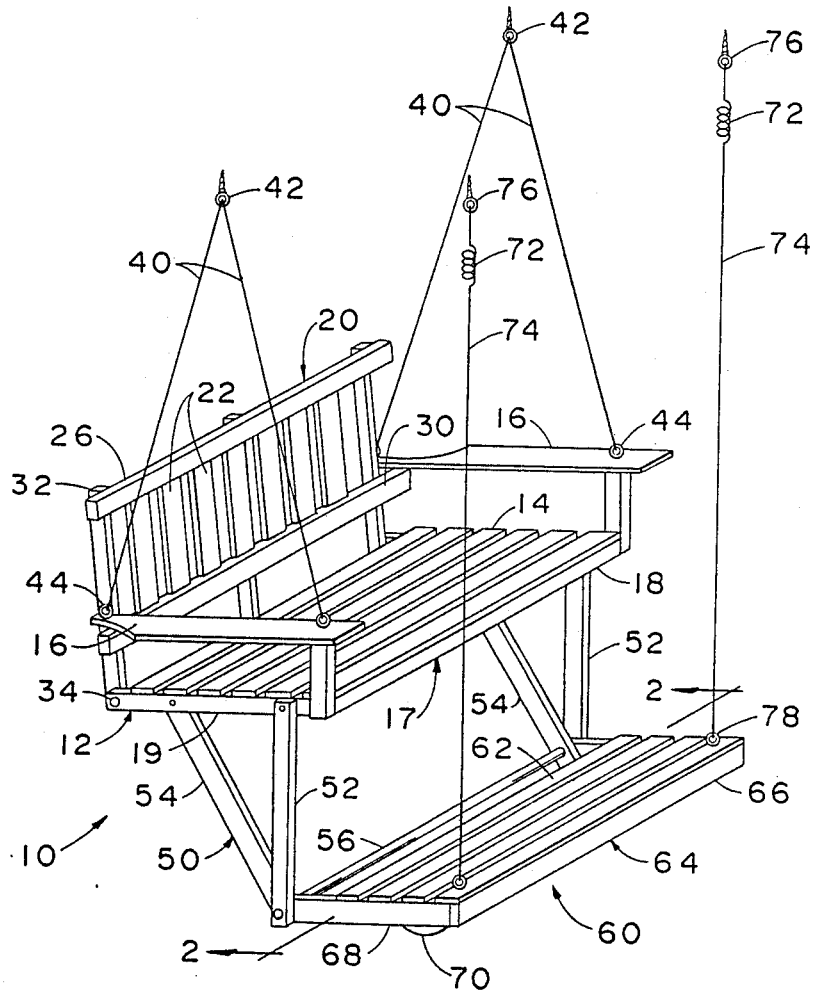
FIG. 1 is a perspective side view of a porch swing having a platform which comprises a first embodiment of the invention.
Figure 2:
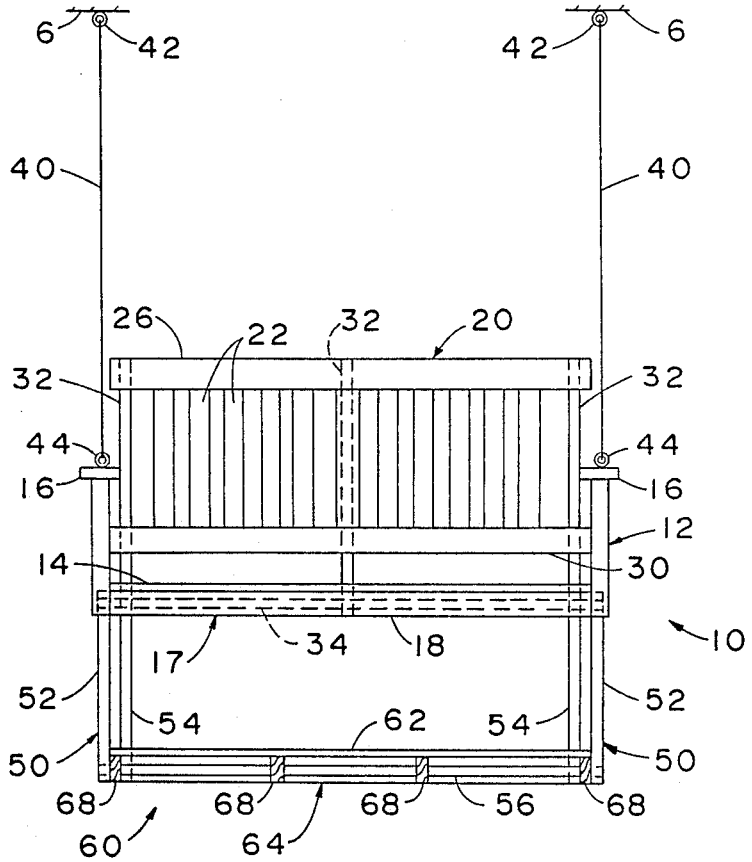
FIG. 2 is a front section view of the porch swing of FIG. 1 taken along line 2—2.
Figure 3:
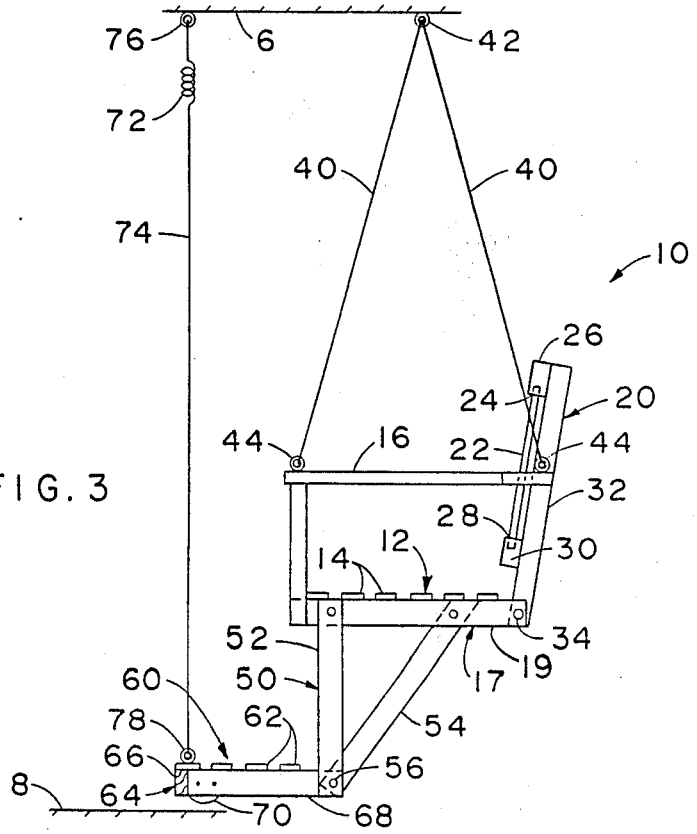
FIG. 3 is a side view of the porch swing of FIG. 1.

FIGS. 1–3 generally show a swing such as a porch swing 10 suspended from a ceiling 6 above a floor 8. The porch swing shown is generally made of wood with steel fasteners and comprises a generally horizontally extending seating member 12 with a back rest member 20 extending upwardly of its back. The seating member 12 has a plurality of generally parallel slats 14 extending between end arms 16 from the front portion to the back portion of the swing 10. The slats 14 are fastened by bolts or other suitable fasteners to an underlying frame 17 which may include a lengthwise front member 18 and front-to-back cross braces 19. Additional cross braces (not shown) may be used to provide intermediate underlying support. The back member 20 generally comprises a plurality of vertical slats 22 extending between a slot 24 in an upper horizontal member 26 and a slot 28 in a lower horizontal member 30. The horizontal members 26, 30 are bolted or otherwise suitably fastened to a plurality of vertical supports 32. The seating member 12 and back rest member 20 are fastened together by a dowel rod 34 extending through aligned holes in the back ends of cross braces 19 and in the vertical supports 32 and also by the ends of the arm rests 16.

The porch swing 10 shown may be suspended from the ceiling 6 of the porch by cords or chains 40 extending between eyebolts 42 fastened to rafters (not shown) in the ceiling 6 and eyebolts 44 fastened to the arm rests 16 of the swing 10.

Two bracket members 50 extend downwardly from the seating member 12. As shown, each bracket member may have a vertical member 52 and a diagonal member 54 which is bolted or otherwise suitably fastened to a cross brace 19 of the seating member 12 at its upper end. These members are then interconnected at their lower ends by a dowel rod 56 extending through aligned holes in the bracket members 50. The bracket members 50 support a platform member 60 below the seating member. The vertical members 52 are designed to carry the weight of the platform member 60 and the load. The diagonal members 54 are designed to resist the backward thrust exerted on the platform member 60.

Platform member 60 is most preferably pivotally attached to the bracket members 50 and extends generally horizontally and beyond the front portion of the seating member 12. The platform member 60 has a plurality of slats 62 supported by an underlying frame 64 comprising a lengthwise front member 66 and front-to-back cross members 68. The cross members have holes in their back ends aligned with the holes in the lower ends of the bracket members 50 for receiving the dowel rod 56. The platform member 60 pivots about the dowel rod 56 between a horizontal position about two inches above the floor 8 to a slightly inclined position where a ground engaging means such as the front portion of the platform member 60 disposed forwardly of the pivotal attachment engages the floor 8. Preferably, a means such as runners 70 are bolted or otherwise suitably attached to the cross braces 68 for engaging the floor 8. The runners may preferrably be plastic, rubber or other yieldable material for cushioning the contact of the platform member 60 with the floor 8. Although the platform member 60 is shown as having a length spanning the length of the seating member 12, the platform member 60 may be of any length.

Figure 4:
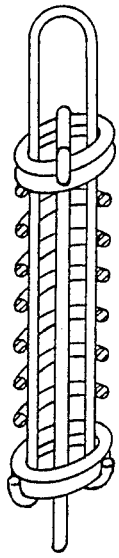
FIG. 4 is a schematic partial perspective view of a compression spring which alternatively may be used with the embodiment of the invention shown in FIG. 1.

A spring means is operatively connected to the platform member 60 for urging the platform member 60 away from the floor 8. The spring means, shown in FIGS. 1–3, yieldably supports the front portion of the platform member 60 in a generally horizontal position above the floor 8. Each spring means has an inline coiled tension spring 72 and a chain or cord 74. Preferably the coil spring 72 is supported from an eyebolt 76 fastened to the ceiling 6 and the chain or cord 74 is connected at its lower end to an eyebolt 78 or other suitable fastener attached to the lengthwise member 66 of the platform member 60. This arrangement effectively prevents any possibility of the springs 72 pinching the riders or their clothes. The springs 72 have a spring constant of about ten pounds per inch. Alternatively, the spring 72 could be a compression spring such as a caged spring like that shown in FIG. 4 instead of a tension spring. Such a compression spring could be directly supported from ceiling eyebolt 76 or, alternatively, from the cord or chain 74 and disposed under the platform member 60 where the spring 64 could be operatively connected to the underlying frame of the platform member 60 to protect riders from moving parts of the spring. A caged spring is particularly desirable because the spring would be retained by the case if the spring broke.

An empty swing embodying the present invention such as the above-described porch swing 10 is suspended from the ceiling 6 with the platform member 60 generally horizontal and the bottom of runners 70 about two inches above the floor 8. Such a swing is inherently unstable and will readily sway when the smallest force is exerted on it. However, the swing will be stabilized when a rider steps onto or stands on the slats 62 of the platform member 60. The weight of the rider extends the springs 72 until the runners 70 engage the floor 8. Although it is a principle feature of this invention that a rider need not exert any additional physical effort or give additional attention to stabilize the swing, those boarding riders who have particularly poor balance may, if they desire, manually pull downwardly on a spring means chain or cord 74 to ground the platform member 60 before stepping onto the slats 62. Because the spring extension is only about two inches, the spring means will suitably resist the horizontal forces exerted upon it by the boarding rider. Similarly, an exiting rider who may be feeble may hold down on the spring means chain or cord 74 until he is off the platform member 60 to be sure the platform member 60 does not rise too fast and push upwardly on the rider's trailing foot.

When the rider is seated, the swing may be propelled by pumping the platform member 60 less than about an inch to pull on the spring means. The swing will be propelled as the spring means returns to its normal vertical position and length.

Figure 5:
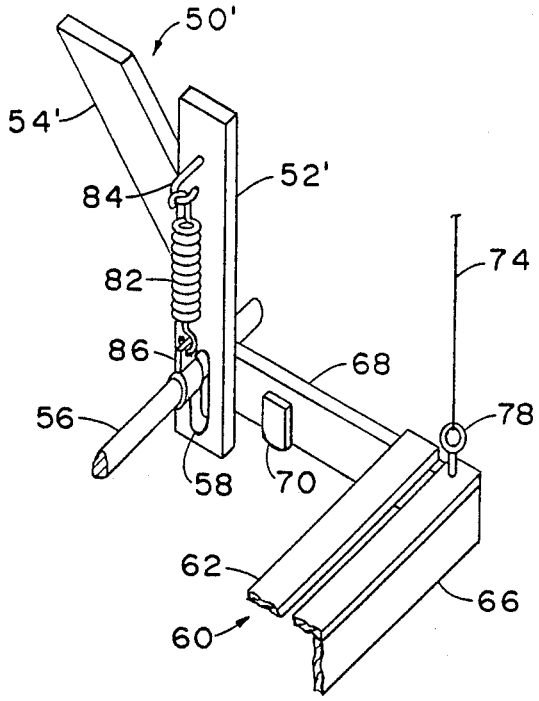
FIG. 5 is a partial front perspective view of the bracket member and the platform member of an embodiment of the invention where a tension spring means is operatively connected with the back portion of the platform.

FIGS. 1–3 generally show an embodiment of the invention where the spring means is attached to the front portion of the platform member. In such an embodiment, the swing is normally propelled by the riders pumping the platform with the balls and toes of their feet. In an alternative embodiment, the spring means is attached to the back portion of the platform member so that the swing can be propelled by the riders with the heels of their feet. FIG. 5 shows an embodiment of the invention where a spring means comprises a tension spring 82 connected to the back portion of the platform member 60 below the seating member 12 so that the riders are protected from pinching spring parts.

FIG. 5 generally shows one of two bracket means 50' which extend downwardly of the seating member 12 of FIGS. 1–3 for supporting the back portion of a platform member 60 via a rod 56. The front portion of the platform member 60 is supported by a cord or chain 74. The bracket member 50' has a vertical member 52' fastened to the seating member 12 at its upper end (not shown) and a vertically elongated slot 58 in its lower end for receiving the rod 56. A diagonal bracket member 54' is fastened to the seating member 12 at its upper end (not shown) and to the vertical member 52' at its lower end for resisting the thrust exerted upon the vertical member 52'. The rod 56 extends through the slot 58 in the vertical bracket member 52' and a hole in the platform cross member 68 for attaching the platform member 60 to the bracket member 52'. As was shown in FIGS. 1 and 2, the rod 56 preferrably spans the bracket members located at the ends of the swing and extends through one or more intermediate cross members 68 of the platform member 60.

As is shown in FIG. 5, the spring means comprising the tension spring 82 may be operatively connected with the back portion of the platform member 60 via the rod 56. The tension spring 82 is supported by a hook 84 fastened to the vertical bracket member 52' and in turn supports a spring adapter 86 which carries the rod 56. The platform member 60 is normally horizontal with the rod 56 at the top of the slot 58 and the spring 82 in tension when a rider is not exerting a significant force on the platform slats 62. When a rider is pumping the platform member 60 in opposition to the spring 82, the rod 56 moves vertically in the slots 58. When a rider is standing on the platform member 60, the spring 82 extends and the rod 56 moves downwardly in the slot 58 until the runner 70 engages the ground. Although the spring means is preferrably located on the inner side of the bracket members 52' as shown, the spring may alternatively be located on the outer side of the bracket member 52' as well and the spring 82 may be directly connected to the cross member 68 or to the rod 56.

Figure 6:
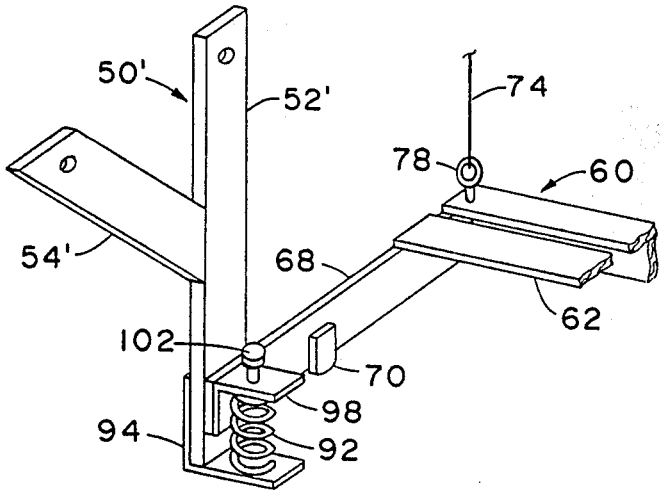
FIG. 6 is a partial rear perspective view of the bracket member and the platform member of an embodiment of the invention where a compression spring is operatively connected with the back portion of the platform.
Figure 7:
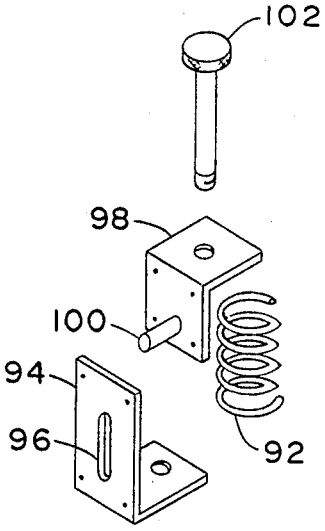
FIG. 7 shows an exploded view of the spring means of FIG. 6.

FIGS. 6 and 7 shows an embodiment of the invention where a spring means comprises a compression spring 92 connected to the back portion of the platform member 60. In this embodiment, a first bracket plate 94 having a slot 96 is fastened to the vertical bracket member 52' such that slot 96 is aligned with the vertical slot 58 of the vertical bracket member 52'. A second bracket member 98 is fastened to the platform cross member 68. A pin 100 extends through aligned holes of the vertical bracket member 52', the cross member 68 and their first and second brackets 94 and 98 for moveably interconnecting the platform member 60 with the vertical bracket member 52'. The compression spring 92 is disposed between the horizontal portions of the brackets 94 and 98 and the assembly is held in place by bolting 102.

While presently preferred embodiments of the invention have been shown and described, it is to be distinctly understood that the invention is not limited thereto, but may be otherwise variously embodied within the scope of the following claims.

I claim:

1. A swing for supporting a rider above a ground level, the swing having a generally horizontally extending seating member with a front portion and a back portion, a back rest member extending upwardly of the back portion of the seating member, at least one bracket member extending downwardly of the seating member, a platform member with a front portion and a back portion, the platform member being attached to the at least one bracket member and extending generally horizontally below and beyond the front portion of the seating member, the platform member having a means for engaging the ground when a rider is standing on the platform, and a spring means operatively connected to the platform for urging the ground engaging means away from the ground and for pumping the swing when the rider is seated on the seating member with his/her feet on the platform.

2. The swing of claim 1 wherein the platform member is pivotally attached to the at least one bracket member.

3. The swing of claim 2 wherein the platform member is attached to two bracket members by a dowel rod extending between the bracket members.

4. The swing of claim 2 wherein the platform member spans the length of the seating member.

5. The swing of claim 2 wherein the ground engaging means of the platform member is disposed between the attachment with the spring means and the attachment with the bracket means.

6. The swing of claim 2 wherein the ground engaging means of the platform member is disposed in front of the attachment with the spring means and the bracket member.

7. The swing of claim 2 wherein the spring means comprises a tension spring.

8. The swing of claim 2 wherein the spring means comprises a caged spring.

9. The swing of claim 2 wherein the spring means comprises a compression swing.

10. The swing of claim 2 wherein the spring means is operatively connected via a length of chain or cord with the front portion of the platform member.

11. The swing of claim 2 wherein the spring means is operatively connected with the back portion of the platform member.

12. A swing for supporting a rider above a ground level, the swing having a generally horizontally extending seating member with a front portion and a back portion, a back rest member extending upwardly of the seating member, at least one bracket member extending downwardly of the seating member, a platform member attached to the at least one bracket member and extending generally horizontally below and beyond the front portion of the seating member, the platform member having a ground-engaging portion for engaging the ground when a rider is standing on the platform, and a spring operatively connected to the platform urging the ground-engaging means away from the ground and for pumping the swing when the rider is seated on the seating member with his/her feet on the platform.

* * * * *